US011970307B2

(12) United States Patent
Westad

(10) Patent No.: US 11,970,307 B2
(45) Date of Patent: Apr. 30, 2024

(54) CONTAINER FOR STORING PERSONAL CARE ITEM

(71) Applicant: Pak Products, LLC, Lakeville, MN (US)

(72) Inventor: Kate Westad, Lakeville, MN (US)

(73) Assignee: Pak Products, LLC, Lakeville, MN (US)

( * ) Notice: Subject to any disclaimer, the term of this patent is extended or adjusted under 35 U.S.C. 154(b) by 0 days.

(21) Appl. No.: 17/662,320

(22) Filed: May 6, 2022

(65) Prior Publication Data

US 2022/0258922 A1 Aug. 18, 2022

Related U.S. Application Data

(63) Continuation of application No. 16/869,443, filed on May 7, 2020, now Pat. No. 11,325,750, which is a (Continued)

(51) Int. Cl.

| | |
|---|---|
| ***B65D 25/20*** | (2006.01) |
| ***B65D 1/40*** | (2006.01) |
| ***B65D 43/02*** | (2006.01) |

(52) U.S. Cl.

CPC ..... *B65D 25/20* (2013.01); *B65D 1/40* (2013.01); *B65D 43/0231* (2013.01)

(58) Field of Classification Search

CPC .... B65D 21/0201; B65D 25/20; B65D 71/50; B65D 85/62; B65D 2251/0015; A47F 7/285; B44D 3/04

See application file for complete search history.

(56) References Cited

U.S. PATENT DOCUMENTS

| | | | |
|---|---|---|---|
| 2,166,616 | A | 7/1939 | Willis |
| 2,446,451 | A | 8/1948 | Allen |

(Continued)

FOREIGN PATENT DOCUMENTS

| | | | |
|---|---|---|---|
| EP | 0179005 | A1 | 4/1986 |
| WO | 2020227565 | A1 | 11/2020 |

OTHER PUBLICATIONS

Final Rejection, dated Jun. 11, 2021, 18 pages, issued in U.S. Appl. No. 16/869,443.

(Continued)

*Primary Examiner* — Andrew T Kirsch

(74) *Attorney, Agent, or Firm* — AVEK IP, LLC

(57) ABSTRACT

A container for storing and carrying at least one personal care item includes a base plate and well. The base plate defines an aperture and has top and bottom surfaces. The well passes through the aperture and has: an open top portion and a closed bottom portion collectively defining a chamber accessible through the top portion, a seat abutting the bottom surface, and a flange overlying a portion of the base plate. A cap is removably secured atop the chamber and abuts the flange such that the flange seals between the cap and the base plate when the cap is secured atop the chamber. The well has an uppermost point and a lowermost point and a height defined therebetween, and the lowermost point is collapsible toward the uppermost point to a maximum distance of at least forty percent of the height and no more than sixty percent of the height.

20 Claims, 11 Drawing Sheets

Related U.S. Application Data continuation-in-part of application No. 29/638,880, filed on Mar. 1, 2018, now Pat. No. Des. 891,754.

(60) Provisional application No. 62/845,285, filed on May 8, 2019.

(56) References Cited

U.S. PATENT DOCUMENTS

| | | | | |
|---|---|---|---|---|
| 3,023,884 | A | 3/1962 | Schwartz | |
| 3,661,353 | A | 5/1972 | Newsteder | |
| D227,551 | S | 7/1973 | Crutchfield | |
| 3,858,741 | A | 1/1975 | Smith | |
| 3,884,354 | A * | 5/1975 | Guenther | B65D 71/50 206/427 |
| D236,585 | S | 9/1975 | Tabor | |
| D249,706 | S | 9/1978 | Adamski | |
| D252,072 | S | 6/1979 | Bridges | |
| 4,158,411 | A | 6/1979 | Hall et al. | |
| D253,933 | S | 1/1980 | Bridges | |
| D255,775 | S | 7/1980 | Clemens | |
| 4,574,954 | A | 3/1986 | Reid | |
| D289,978 | S | 5/1987 | Clover, Jr. | |
| 4,757,898 | A | 7/1988 | Klein | |
| D304,629 | S | 11/1989 | Alvarado | |
| 5,346,271 | A | 9/1994 | Erickson | |
| D354,678 | S | 1/1995 | Dalbo | |
| D426,461 | S | 6/2000 | Noble | |
| D441,192 | S | 5/2001 | Park | |
| 6,364,385 | B1 | 4/2002 | Steward et al. | |
| D460,216 | S | 7/2002 | Hong | |
| 6,719,141 | B2 * | 4/2004 | Heinz | B01L 9/06 206/443 |
| D547,443 | S | 7/2007 | Sudo | |
| D587,005 | S | 2/2009 | Gardner | |
| D621,603 | S | 8/2010 | Traylor | |
| D627,151 | S | 11/2010 | Young et al. | |
| 8,251,205 | B2 | 8/2012 | Azera | |
| 8,887,942 | B2 | 11/2014 | Miksovsky et al. | |
| D749,428 | S | 2/2016 | Fath | |
| D749,429 | S | 2/2016 | Fath | |
| D789,217 | S | 6/2017 | Antons | |
| D812,245 | S | 3/2018 | Hommel et al. | |
| 11,325,750 | B2 * | 5/2022 | Westad | B65D 43/0231 |
| 2004/0040972 | A1 | 3/2004 | Haj | |
| 2005/0211597 | A1 | 9/2005 | Penfold et al. | |
| 2008/0179215 | A1 | 7/2008 | Arvin | |
| 2010/0000905 | A1 * | 1/2010 | Wang | B65D 83/02 206/569 |
| 2011/0198253 | A1 | 8/2011 | Sato et al. | |
| 2014/0216979 | A1 | 8/2014 | Veltrop et al. | |
| 2017/0238671 | A1 | 8/2017 | Berhault | |
| 2020/0262612 | A1 | 8/2020 | Westad | |

OTHER PUBLICATIONS

International Search Report and Written Opinion, dated Jul. 29, 2020, 13 pages, issued in Application No. PCT/US2020/031931.

Non-Final Office Action, dated Feb. 26, 2021, 15 pages, issued in U.S. Appl. No. 16/869,443.

Notice of Allowance, dated Jan. 10, 2022, 7 pages, issued in U.S. Appl. No. 16/869,443.

Intention to Grant, dated Feb. 20, 2023, issued in Great Britain patent application 2115997.5, 2 pages.

Notification of Grant received in GB Application No. 2115997.5, received Apr. 4, 2023.

Written Opinion, dated Jun. 8, 2023, 7 pages, issued in Singapore Patent Application No. 11202112311R.

* cited by examiner

CONTAINER FOR STORING PERSONAL CARE ITEM

RELATED APPLICATIONS

This application is a continuation of U.S. application Ser. No. 16/869,443, filed May 7, 2020, which claims priority to U.S. Application No. 62/845,285 filed May 8, 2019, and is a continuation-in-part of U.S. Design Application No. 29/638,880 filed Mar. 1, 2018. Each is hereby incorporated by reference in its entirety.

BACKGROUND

Travelers use a variety of personal care items (e.g., cosmetic, beauty, and/or toiletry items), such as lotions, liquids, creams, pastes, powders, and oils. It can be extremely inconvenient to be without these personal care items, but these items and their associated containers can consume a large amount of space. And even if a traveler chooses to transport these items, current packaging of personal care items is often breakable and thus hazardous. There is a need for a container that facilitates carrying personal care products, minimizes the amount of space required for packing, allows for customization of amount and quantity of said items, and avoids leakage. Further, when traveling by air, there is a need to meet air travel carry-on liquid volume limitations. The current invention may address one or more of these needs, but is not required to do so unless set forth in the claims.

SUMMARY

The following presents a simplified summary of the disclosure in order to provide a basic understanding of some aspects of the disclosure. This summary is not an extensive overview of the disclosure. It is not intended to identify critical elements of the disclosure or to delineate the scope of the disclosure. Its sole purpose is to present some concepts of the disclosure in a simplified form as a prelude to the more detailed description that is presented elsewhere.

According to an embodiment, a container for storing and carrying at least one personal care item includes a base plate, a well, and a cap. The base plate defines an aperture and has top and bottom surfaces. The well has an open top portion and a closed bottom portion, and the top and bottom portions collectively define a chamber accessible through the open top portion. The well has a seat abutting the base plate bottom surface, and the well passes through the aperture and has a flange overlying a portion of the base plate. The cap is removably secured atop the chamber, and the cap abuts the flange such that the flange seals between the cap and the base plate when the cap is secured atop the chamber. The well has an uppermost point and a lowermost point and a height defined therebetween, and the lowermost point is collapsible toward the uppermost point to a maximum distance of: at least forty percent of the height and no more than sixty percent of the height.

According to another embodiment, the basic and novel characteristics of a container for storing and carrying at least one personal care item are a base plate, a plurality of generally uniform wells, and a plurality of generally uniform caps having the following features. The base plate defines a plurality of generally uniform apertures and has top and bottom surfaces. There are as many well as apertures and caps. Each well passes through a respective aperture and has: an open top portion and a closed bottom portion, with the top and bottom portions collectively defining a chamber accessible through the open top portion; a seat abutting the base plate bottom surface; a flange overlying a portion of the base plate; and an uppermost point and a lowermost point and a height defined therebetween, with the lowermost point being collapsible toward the uppermost point to a maximum distance of: at least forty percent of the height and no more than sixty percent of the height. Each cap is removably secured atop a respective chamber, and each cap abuts a respective flange such that the flanges seal between the caps and the base plate when the caps are secured atop the chambers.

According to still another embodiment, the basic and novel characteristics of a container for storing and carrying at least one personal care item are a base plate, a plurality of wells, and a plurality of caps having the following features. The base plate defines a plurality of apertures and has top and bottom surfaces. There are as many wells as apertures and caps. Each well passes through a respective aperture and has: an open top portion and a closed bottom portion, with the top and bottom portions collectively defining a chamber accessible through the open top portion; a seat abutting the base plate bottom surface; and a flange overlying a portion of the base plate. Each cap is removably secured atop a respective chamber, and each cap abuts a respective flange such that the flanges seal between the caps and the base plate when the caps are secured atop the chambers.

DETAILED DESCRIPTION

Figure 1:
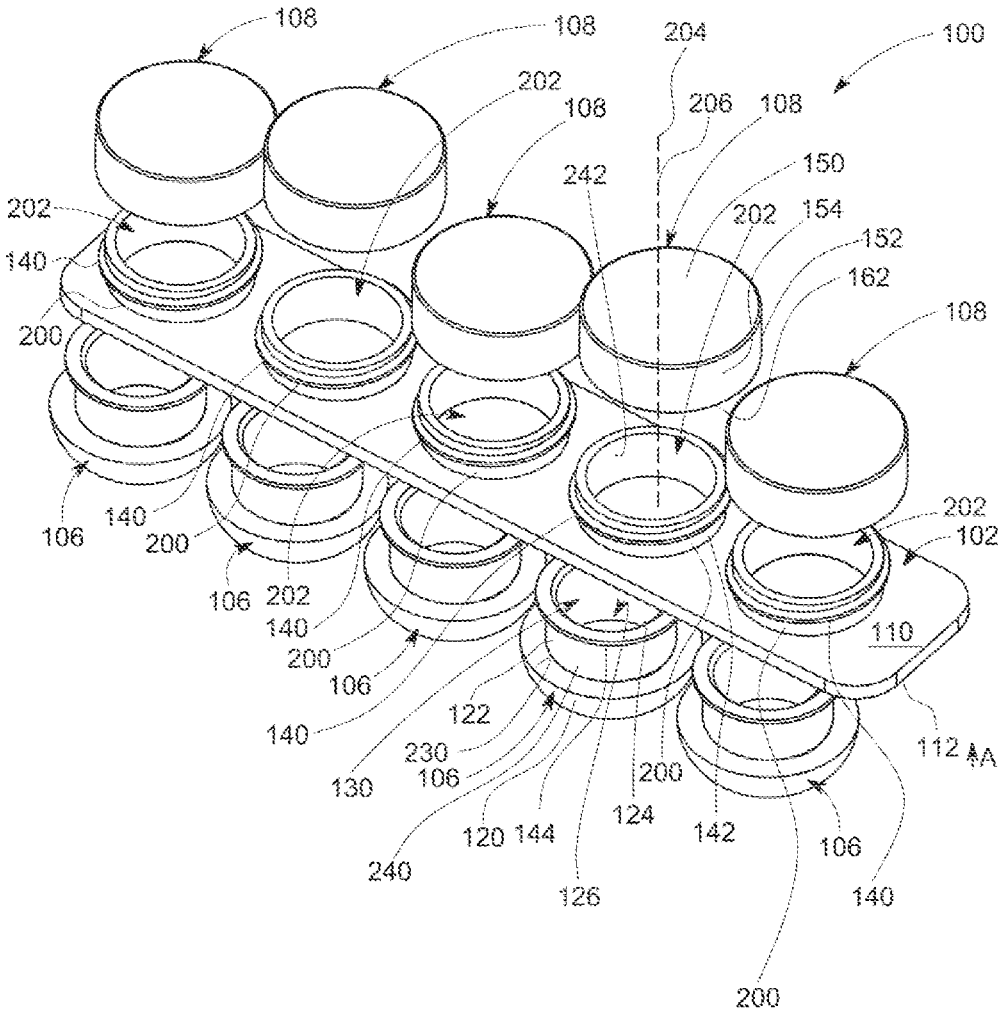
FIG. 1 is a top perspective exploded view of a travel container, in accordance with an embodiment of the disclosure.
Figure 2:
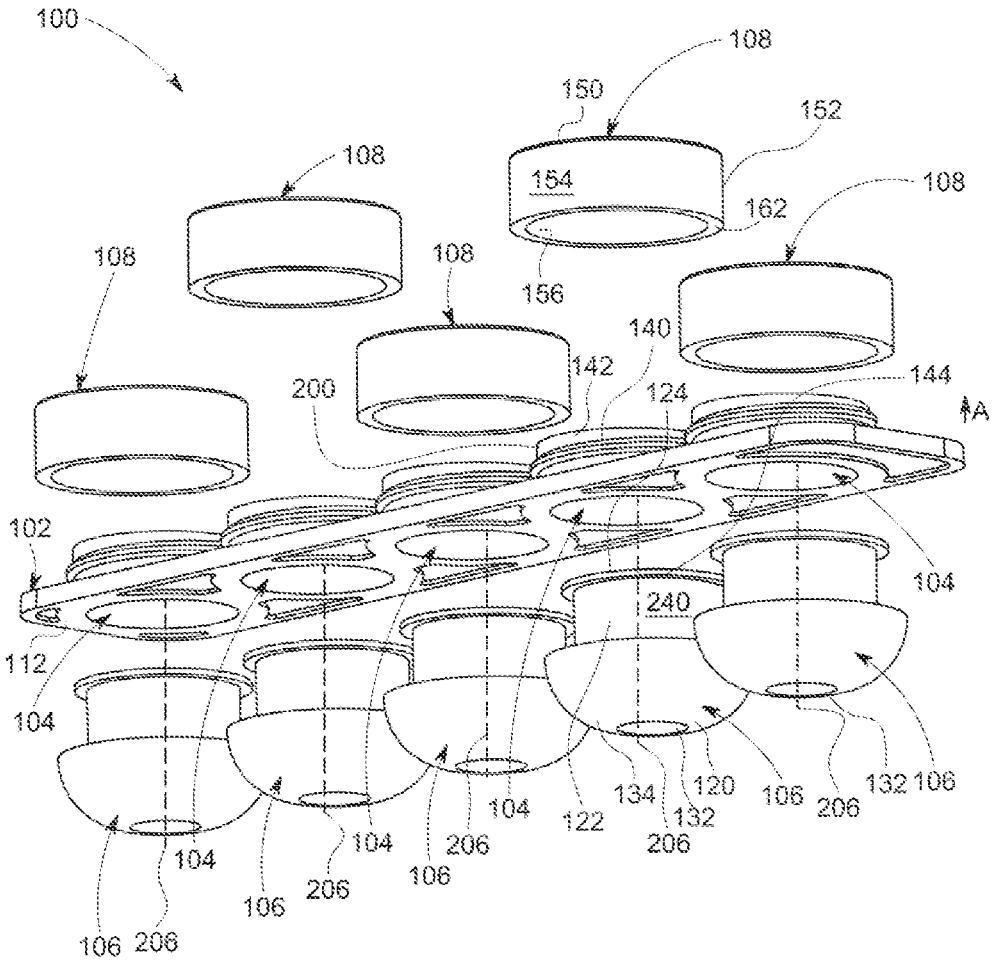
FIG. 2 is a bottom perspective exploded view of the travel container of FIG. 1.

FIGS. 1 through 5 illustrate an exemplary travel container 100 suitable for storing and carrying one or more personal care items, such as lotions, liquids, creams, pastes, powders, oils, et cetera. The travel container 100 includes a base plate 102 defining a plurality of apertures 104, a plurality of wells 106 for storing the personal care items, and a plurality of caps 108 removably engaged with the plurality of wells 106 for covering the plurality of wells 106. Although a generally-rectangular base plate 102 is shown, the base plate 102 may form any other appropriate shape, such as circular, elliptical, square, octagonal, et cetera. It may be particularly desirable for the plurality of apertures 104 to be arrayed generally linearly along a length (e.g., along a longitudinal axis) of the base plate 102. But while a linear arrangement of the apertures 104 is shown, the plurality of apertures 104 may form a circular array, a wave, or any other appropriate design.

The base plate 102 has opposed top and bottom surfaces 110, 112, and each of the apertures 104 may fully extend through the base plate 102 so as to pass through the top surface 110 and the bottom surface 112. Further, the base plate 102 may include a plurality of wall portions 200, with each wall portion 200 encircling a corresponding aperture 104 and extending outwardly away from (and preferably generally perpendicular to) the top surface 110. The wall portion 200 defines a cavity 202 having a vertical axis 204 aligned with a vertical axis 206 of the corresponding aperture 104.

The base plate 102 and the wall portions 200 support the wells 106 such that a respective well 106 passes through each aperture 104 and cavity 202 and extends both below the base plate 102 and above a corresponding wall portion 200. Further, each wall portion 200 includes threading 140 (e.g., at an outer surface 142 of the wall portion 200). The threading 140 facilitates engagement of the caps 108, as described further below. For sake of simplicity and clarity, the travel container 100 is generally described with references to structure, function, and assembly of a single well 106 and a single cap 108; one of skill in the art shall appreciate that the description may be equally applicable to all of the wells 106 and the caps 108.

Referring to FIGS. 1 to 5, the well 106 includes a lower portion 120 and an upper portion 122 extending from the lower portion 120. The upper portion 122 has an upper edge 124 that defines an access opening 126 of the well 106, and the upper portion 122 extends substantially cylindrically from the upper edge 124 to the lower portion 120. The lower portion 120 extends from the upper portion 122 to a lower end 208 of the well 106. The lower portion 120 defines a first elongated opening 210 extending from inside the lower end 208 to the upper portion 122, while the upper portion 122 defines a second elongated opening 212 extending from the upper edge 124 to the lower portion 120. The first elongated opening 210 and the second elongated opening 212, and hence the lower portion 120 and the upper portion 122, together define a chamber 130 for receiving and storing the personal item. As shown, the first elongated opening 210 may be coaxial with the second elongated opening 212, and each may be substantially cylindrical.

Further, the lower portion 120 may include a central flat portion 132 and a peripheral curved portion 134 connecting the upper portion 122 to the central flat portion 132. In an embodiment, the peripheral curved portion 134 meets the central flat portion 132 such that an inner surface 220 of the central flat portion 132 extends substantially tangentially from an inner surface 222 of the peripheral curved portion 134. The upper portion 122 may be disposed substantially perpendicularly to the central flat portion 132. Alternatively, the lower portion 120 (and the inner surface 220) may include a hemispherical shape to facilitate an easy (e.g., one-finger) removal of the cosmetic items from the well 106. The lower portion 120 may be disposed on the bottom surface 112 of the base plate 102, while the upper portion 122, at least partly, is located above the top surface 110 of the base plate 102 such that the access opening 126 is located above the base plate 102. The configuration and material may also have specific advantages in allowing multiple containers 100 to be stacked atop one another.

Figure 5:
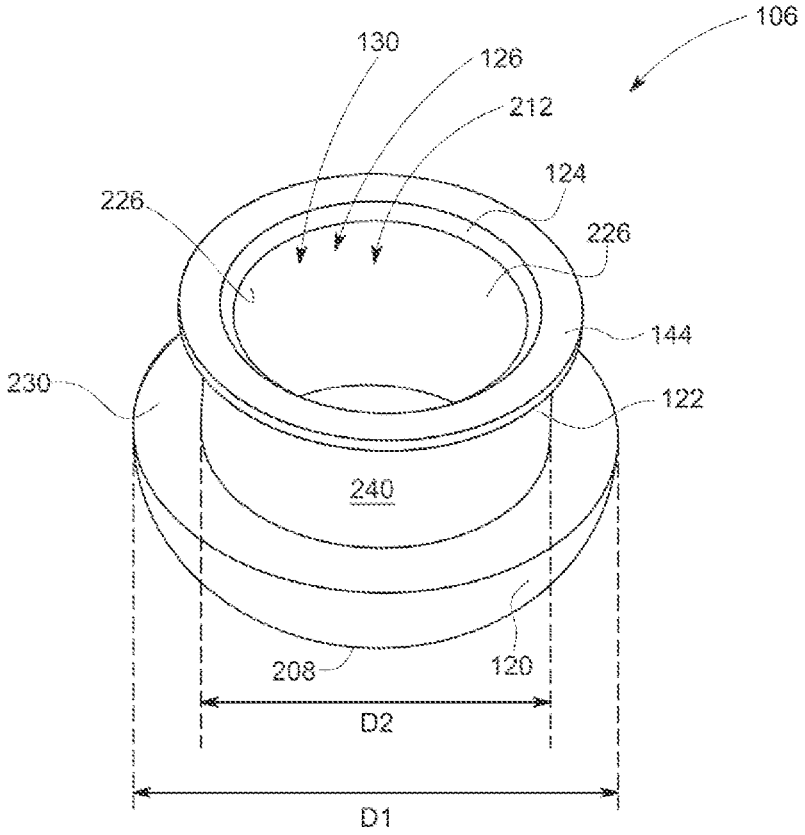
FIG. 5 is a perspective view of a well of the travel container of FIG. 1.
Figure 6:
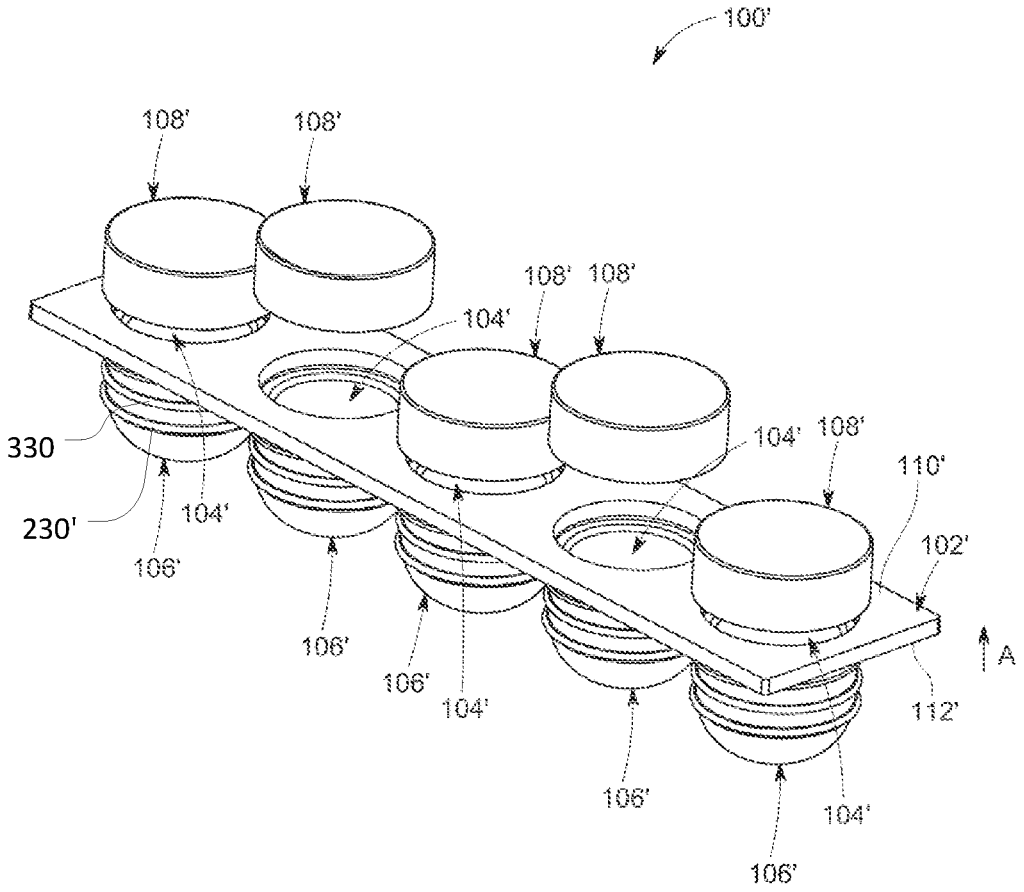
FIG. 6 is a top perspective exploded view of a travel container, in accordance with another embodiment of the disclosure.
Figure 7:
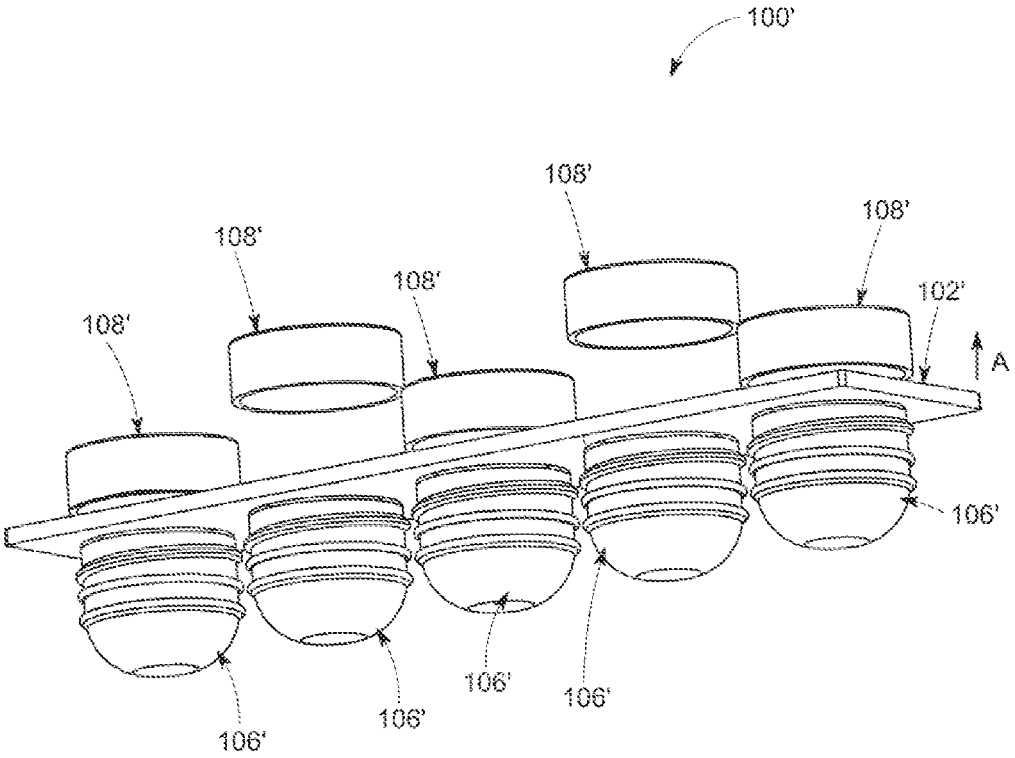
FIG. 7 is a bottom perspective exploded view of the travel container of FIG. 6.
Figure 8:
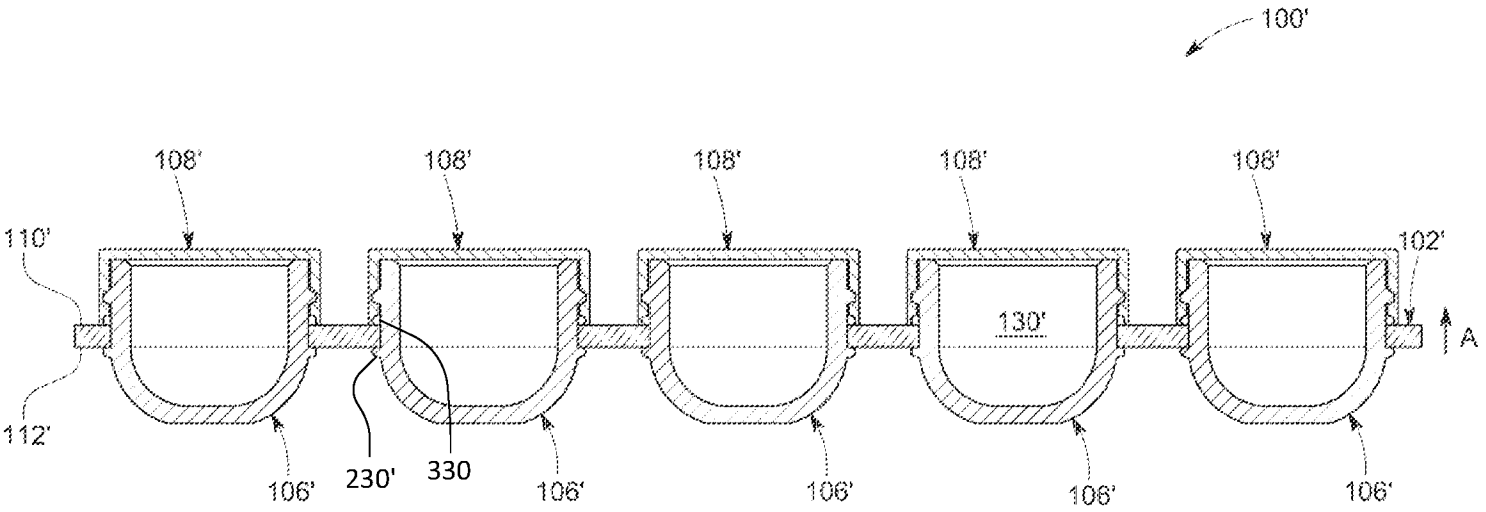
FIG. 8 is a front sectional view of the travel container of FIG. 6.
Figure 9:
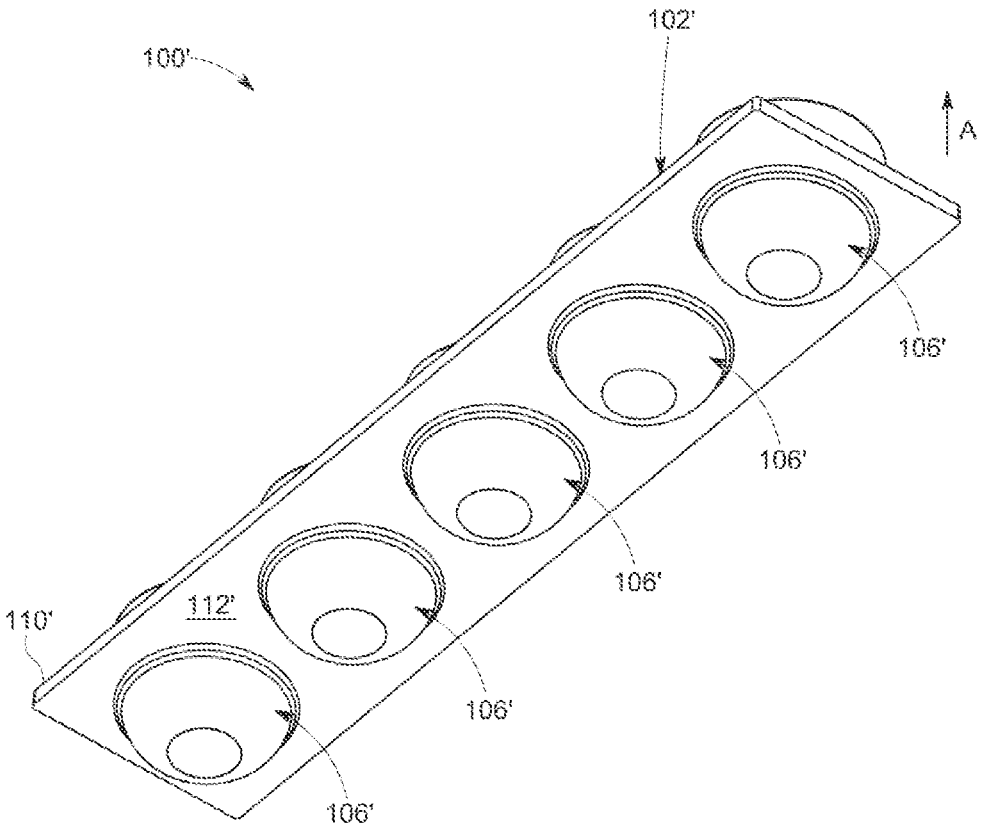
FIG. 9 is a bottom perspective view of the travel container of FIG. 6.
Figure 10:
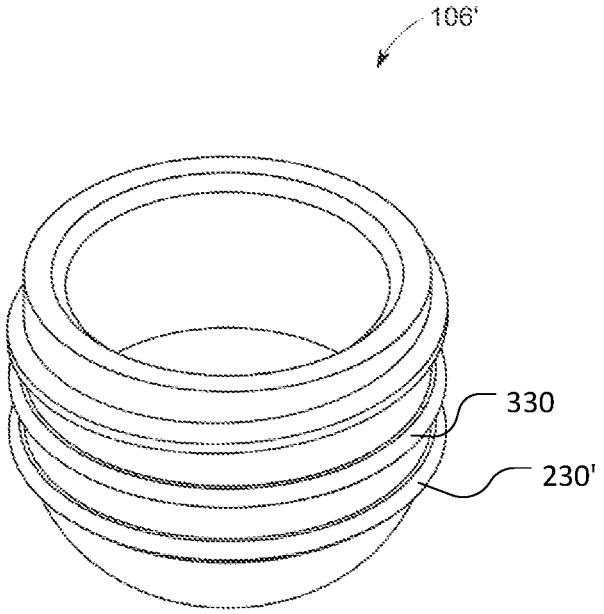
FIG. 10 is a perspective view of a well of the travel container of FIG. 6.

Also, as shown in FIG. 5, an outer diameter D1 of the lower portion 120 may be greater than an adjacent outer diameter D2 of the upper portion 122, thereby defining a seat or "step" 230 at an interface of the lower portion 120 and the upper portion 122. It may be desirable for D2 to be between two-thirds and three-fourths of D1. The step 230 is adapted to abut the bottom surface 112 of the base plate 102 to restrict or prevent a movement of the step 230 in a first direction A when a push force is applied at the lower portion 120 (i.e., to the central flat portion 132) from outside of the well 106. A person may apply the push force on the central flat portion 132 of the lower portion 120 to push at least a part of the central flat portion 132 inside the chamber 130 to facilitate an easy and complete removal of the personal item from the chamber 130. For so doing, the central flat portion 132 is made of a relatively flexible and resilient material so that the central flat portion 132 may automatically return to an original configuration when the push force is removed. In some embodiments, the curved portion 134 may also be constructed of a flexible and resilient material, and it may be desirable for the flat portion 132 and the curved portion 134 to be constructed as one piece from the same material. In some embodiments, the flat portion 132 includes a gripping texture to enhance friction between the flat portion 132 and a support surface such as a counter or table. Moreover, by being generally flat, the flat portion 132 may help prevent the container 100 from tipping over when sitting.

Additionally, the well 106 includes a flange 144 disposed at the upper edge 124 of the well 106, and the flange extends radially outwardly from an outer surface 240 of the upper portion 122 to cover the wall portion 200. In such a case, the outer surface 240 of the upper portion 122 abuts an inner surface 242 of the wall portion 200 such that the wall portion 200 surrounds much of the upper portion 122. When fully assembled, the flange 144 engages the cap 108 and defines a sealing connection between the well 106 and the cap 108, with the flange 144 disposed between the wall portion 200 and an inner surface of the cap 108. It may be desirable for an external diameter of the flange 144 to be between eighty and ninety percent of the diameter D1.

It may be particularly desirable for the well 106 to be overmolded or otherwise adhered to the base plate 102. For example, the flange 144 may be adhered to a top surface of the wall portion 200, the outer surface 240 may be adhered to the inner surface 242, and/or the step 230 may be adhered to the bottom surface 112. In some embodiments, the bottom surface 112 includes a protrusion or other coupling feature to assist in adherence between the step 230 and the bottom surface 112. Such protrusions may form an annular ring or any other appropriate feature as desired. In any event, securing the well 106 to the base plate 102 may prevent undesired separation of the well 106 with respect to the base plate 102. Moreover, by making the step 230 sufficiently wide, adhering the step 230 to the base plate 102, and selecting a resilient material for the well 106, a push force on the central flat portion 132 may move the inner surface 220 of the central flat portion 132 to a maximum position upward that is between forty and sixty percent of the height of the well 106, which may be particularly desirable in some embodiments. As shown, each well 106 may be independently coupled to the base plate 102, though in other embodiments multiple wells 106 may be jointly formed.

Figure 3:
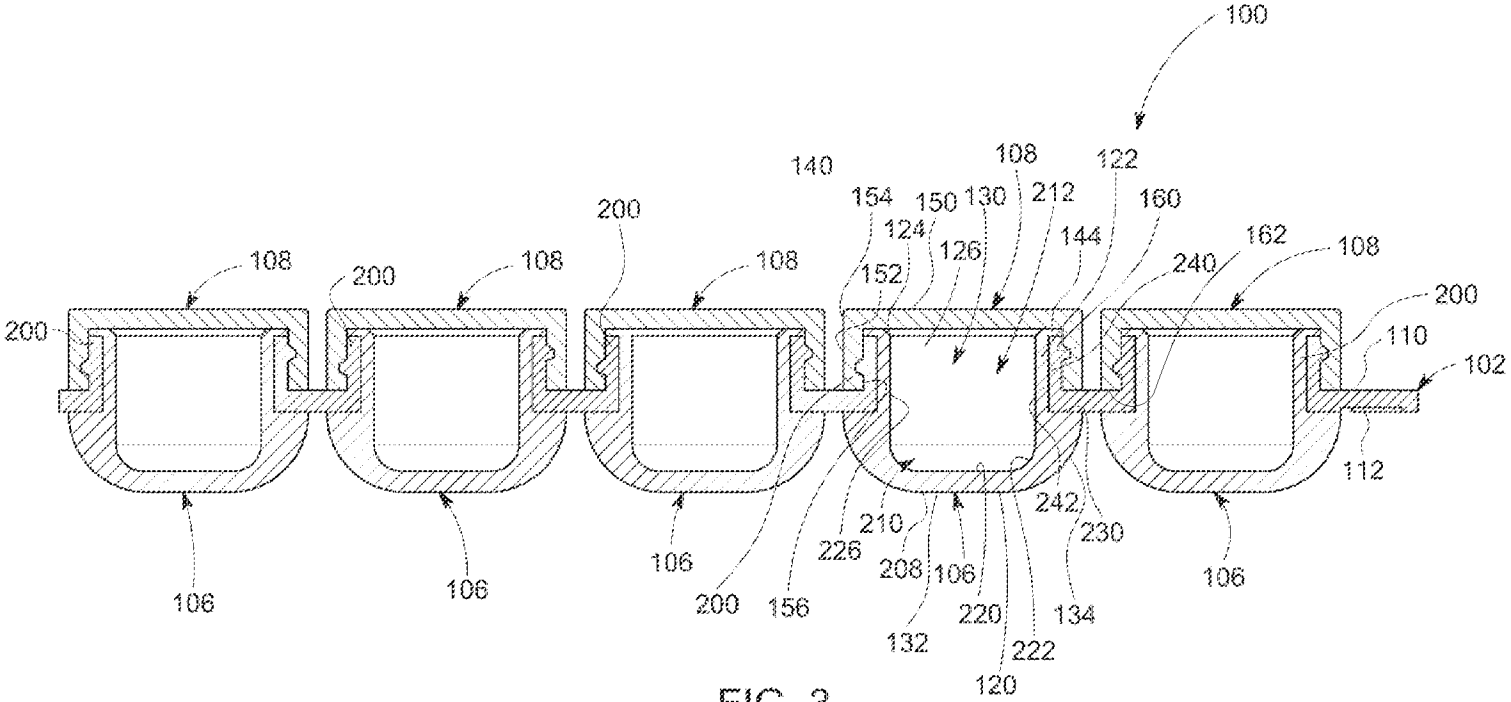
FIG. 3 is a front sectional view of the travel container of FIG. 1.

The cap 108 is configured to cover the access opening 126, and includes a cover portion 150 and an upright portion 152 (e.g., extending substantially perpendicularly from the cover portion 150). The upright portion 152 has an outer surface 154 and an inner surface 156, and may extend circularly along an edge of the cover portion 150. When in use, the cover portion 150 covers the access opening 126 of the well 106 while the upright portion 152 surrounds the wall portion 200. As shown in FIG. 3, the cap 108 includes threading 160 (e.g., defined along the inner surface 156 of the upright portion 152) complementary to the threading 140. During transport, each cap 108 may be threaded onto its corresponding wall portion 120 (using the threading 160 and the threading 140) to ensure a tight fit over each corresponding well 106. Although a threaded engagement is shown, other types of couplings, such as snap fittings, may also be acceptable.

Figure 4A:
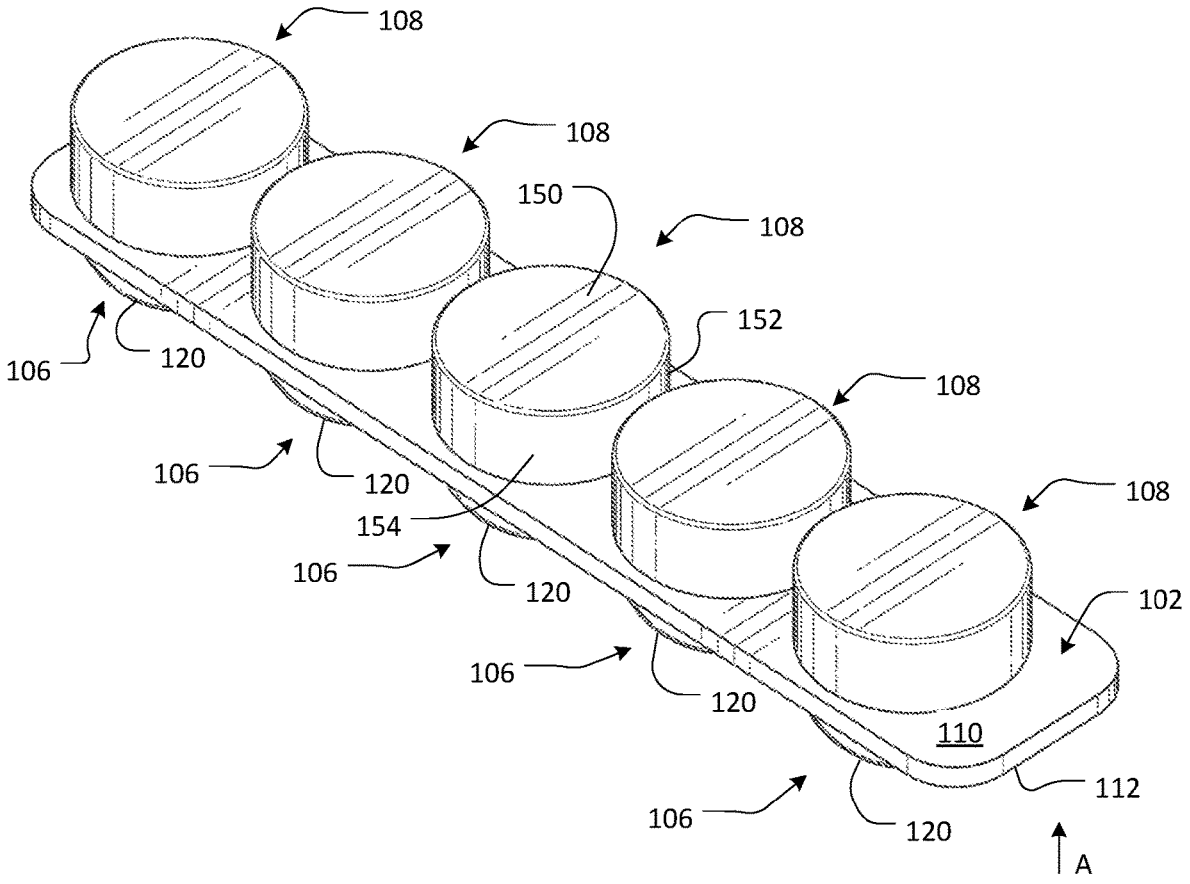
FIG. 4A is a top perspective view of the travel container of FIG. 1.
Figure 4B:
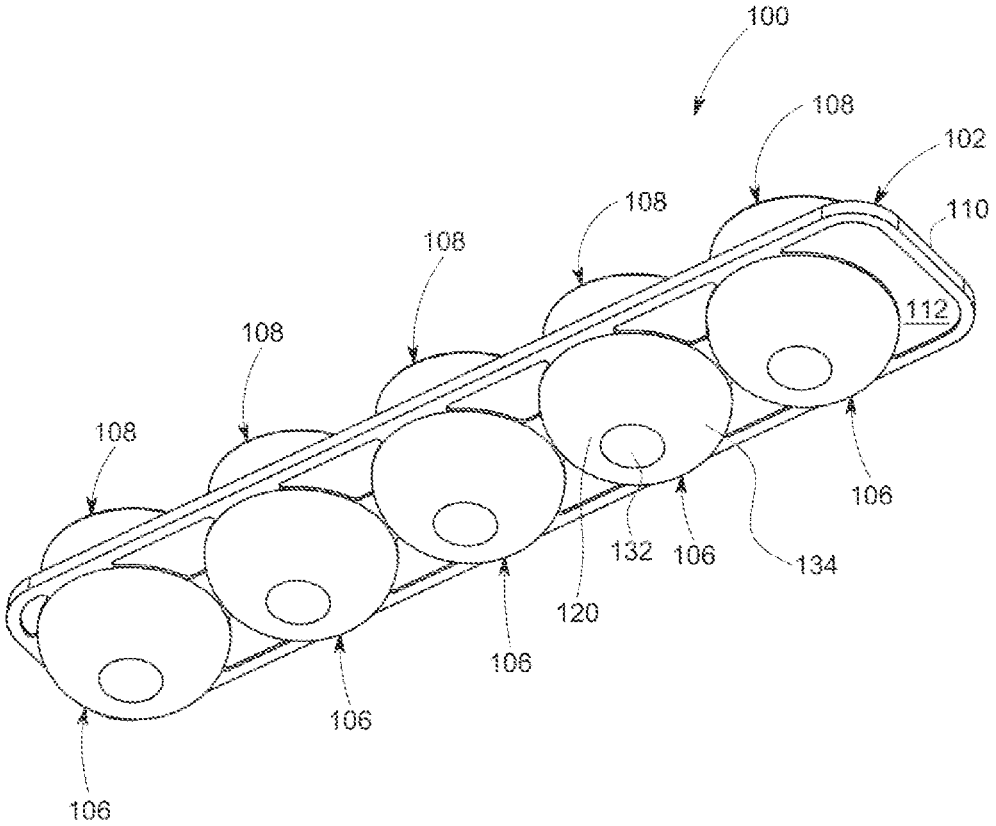
FIG. 4B is a bottom perspective view of the travel container of FIG. 1.

It may be particularly desirable for the cap 108 to engage the flange 144 of the well 106 and form a seal therebetween to prevent leakage of personal items from the well 106. When assembled, as shown in FIGS. 3 through 4B, the cover portion 150 rests against the flange 144, while the upright portion 152 may engage a side portion of the flange 144. Further, to facilitate sealing between the cap 108 and the flange 144, the cap 108 may be lowered to deform the flange 144 when the cap 108 is engaged with the well 106. For so doing, material for the flange 144 (i.e., for the well 106) and the cap 108 may be selected such that the flange 144 is less rigid than the cap 108. For example, the flange 144 can be formed of a material (e.g., silicone rubber) that will deform between the inner surface 156 and the top surface of the wall portion 200, which may be formed of materials that will not significantly deflect upon tightening of the cap 108 onto the wall portion 200. Further, a free end 162 of the cap 108 may contact the top surface 110 of the base plate 102 when the cap 108 is engaged with the well 106. In certain implementations, the cap 108 may include a groove extending circularly on the inner surface 156 of the upright portion 152, and disposed proximate to the cover portion 150. In such a case, the flange 144 may be received within the groove, and the cap 108 and well 106 together may define a sealing connection due an engagement of the flange 144 with the groove. As shown in FIG. 3, an external diameter of the cap 108 may be generally the same as the external diameter of the step 230 (i.e., D1).

In some embodiments, part or all of the well 106 may be constructed of at least one item selected from the group consisting of thermoplastic elastomer, silicone rubber, ethylene propylene diene monomer rubber, neoprene rubber, natural rubber, nitrile rubber, and synthetic rubber. And appropriate materials for the base plate 102 include rigid materials such as high-density polyethylene, acrylonitrile butadiene styrene, polyvinyl chloride, polyethylene terephthalate, polycarbonate, acrylic, fiberglass, polypropylene, nylon, and metal. While using different materials for the base plate 102 and the well 106 (with the well 106 being more elastic than the base plate 102) is generally preferred, some embodiments may nevertheless use the same material for both. And in some embodiments both the base plate 102 and the well 106 may be constructed of rigid material.

While the container 100 may take on various sizes and configurations, there are particular benefits to generally linear or elongate-strip configurations and sizing that allow the container 100 to be held in the palm of a user's hand such that when at least one well 106 rests (though it may be preferable for at least two wells 106 to rest) on the user's palm, the user's thumb can easily access one side of a respective cap 108 while the user's index finger easily accesses an opposite side of the respective cap 108—and together the thumb and index finger can apply and remove the respective cap 108. This allows for one-handed operation. For example, a width of the base plate 102 measured generally perpendicularly to the longitudinal axis of the base plate 102 may preferably be no more than two inches, more preferably no more than one and three-quarter inches, and even more preferably no more than one and five-eighths inches. And a maximum extension of the wells 106 below the bottom surface 112 of the base plate 102 may preferably be no more than three-quarters inch, more preferably no more than one-half inch, and even more preferably no more than three-eighths inch.

FIGS. 6 through 10 show another travel container 100' that is substantially similar to the embodiment 100, except as specifically noted and/or shown, or as would be inherent. Further, those skilled in the art will appreciate that the embodiment 100 (and thus the embodiment 100') may be modified in various ways, such as through incorporating all or part of any of the various described embodiments, for example. For uniformity and brevity, reference numbers with a prime denotation (') may be used to indicate parts corresponding to those discussed above numbered between 100 and 299 (e.g., base plate 102' corresponds generally to the base plate 102; apertures 104' correspond generally to the apertures 104; wells 106' correspond generally to the wells 106; caps 108' correspond generally to the caps 108; top and bottom surfaces 110', 112' correspond generally to the top and bottom surfaces 110, 112; threading 160' corresponds generally to the threading 160; and lower seat 230' corresponds generally to the seat 230), though with any noted or shown deviations.

In the embodiment 100', the base plate 102' omits the wall portions 200. As such, the base plate 102' may simply include the generally flat top and bottom surfaces 110', 112' with the apertures 104' passing therebetween. To compensate for the lack of wall portions 200, the wells 106' are altered. The wells 106' include both a lower seat 230' to abut the bottom surface 112' and an upper seat 330 to abut the top surface 110', with the lower and upper seats 230', 330 sandwiching a portion of the base plate 102' to firmly couple the well 106' to the base plate 102' (see, for example, FIG. 8). The lower and upper seats 230', 330 may be defined, for example, by general areas of larger diameter or by distinct walls. In some embodiments, it may be desirable to overmold or otherwise adhere the wells 106' to the base plate 102'. The wells 106' also include threading 340 complementary to the cap threading 160'.

The travel container 100' may be used generally similarly to the travel container 100, with the main difference being that the caps 108' fasten directly to the wells 106' without wall portions 200.

The travel containers described above may facilitate transport of personal care items, and may particularly prevent leakage of item stored in the wells 106, 106' due to the sealing connection between the caps 108, 108' and the flanges 144, 144'. And because the sealing connection is formed due to an interference fit between the caps 108, 108' and the flanges 144, 144', the sealing capability between the caps 108, 108' and the wells 106, 106' may be maintained even after repeated removal of the caps 108, 108' and without any additional sealing devices. Further, the collapsibility of the wells 106, 106' may allow complete and easy removal of the items from the wells 106, 106'. Because of their configurations, the travel containers 100, 100' may occupy less space than prior devices and may be stored in a handbag, cosmetic, or toiletry bag during travel—providing a convenient means for storing and carrying the items without danger of spillage. This may be particularly useful when traveling by aircraft, as a traveler may carry liquids, creams, and pastes in one convenient (yet separated and isolated) container, while meeting Transportation Security Administration (TSA) regulations.

Various embodiments of the invention have been described above for purposes of illustrating the details thereof and to enable one of ordinary skill in the art to make and use the invention. The details and features of the disclosed embodiment[s] are not intended to be limiting, as many variations and modifications will be readily apparent to those of skill in the art. Accordingly, the scope of the present disclosure is intended to be interpreted broadly and to include all variations and modifications coming within the scope and spirit of the appended claims and their legal equivalents.

The invention claimed is:

1. A container for storing at least one personal care item, the container consisting essentially of:

a base plate, the base plate having opposed top and bottom surfaces, the base plate defining a plurality of apertures, the base plate having a plurality of wall portions irremovably extending above the top surface, each wall portion encircling a respective said aperture;

a plurality of wells extending upwardly from the base plate, each well having:

an open top portion and a closed bottom portion, the top and bottom portions collectively defining a chamber accessible through the open top portion; and a plurality of caps, a number of the caps being the same as the number of the wells, each cap removably secured atop a respective said chamber;

wherein the wells extend downwardly from the base plate; and wherein a width of the base plate measured generally perpendicularly to a longitudinal axis of the base plate is no more than two inches; and wherein a maximum extension of the wells below the bottom surface of the base plate is no more than three-quarters inch; whereby the base plate, the wells, and the caps are collectively sized for one-handed operation.

2. The container of claim 1, wherein:

each well has a flange overlying a portion of the base plate; and each cap abuts a respective said flange for sealing when the caps are secured atop the chambers.

3. The container of claim 2, wherein each well has a seat abutting the bottom surface of the base plate while each cap abuts a respective said flange.

4. The container of claim 3, wherein each seat is adhered to the bottom surface of the base plate.

5. The container of claim 4, wherein each seat is adhered to the bottom surface of the base plate through overmolding.

6. The container of claim 1, wherein the container is configured to resist tipping over.

7. The container of claim 1, wherein there are at least three wells.

8. The container of claim 1, wherein each well has a seat abutting the bottom surface of the base plate.

9. The container of claim 1, wherein:

each well has a lower portion that is resiliently deformable toward a respective said open top portion; and each well has a stationary seat abutting the bottom surface of the base plate.

10. A container for storing at least one personal care item, the container comprising:

a base plate, the base plate having opposed top and bottom surfaces, the base plate defining a plurality of apertures, the base plate having a plurality of wall portions irremovably extending above the top surface, each wall portion encircling a respective said aperture;

a plurality of wells extending upwardly from the base plate, each well having:

an open top portion and a closed bottom portion, the top and bottom portions collectively defining a chamber accessible through the open top portion; and a plurality of caps, a number of the caps being the same as the number of the wells, each cap removably secured atop a respective said chamber;

wherein the wells extend downwardly from the base plate; and wherein a width of the base plate measured generally perpendicularly to a longitudinal axis of the base plate is no more than two inches; and wherein a maximum extension of the wells below the bottom surface of the base plate is no more than three-quarters inch; whereby the base plate, the wells, and the caps are collectively sized for one-handed operation.

11. The container of claim 10, wherein:

each well has a flange overlying a portion of the base plate; and each cap abuts a respective said flange for sealing when the caps are secured atop the chambers.

12. The container of claim 11, wherein each well has a seat abutting the bottom surface of the base plate while each cap abuts a respective said flange.

13. The container of claim 10, wherein the container is configured to resist tipping over.

14. The container of claim 10, wherein there are at least three wells.

15. The container of claim 10, wherein each well has a seat abutting the bottom surface of the base plate while each cap abuts a respective said flange.

16. The container of claim 15, wherein each seat is adhered to the bottom surface of the base plate.

17. The container of claim 10, wherein:

each well has a lower portion that is resiliently deformable toward a respective said open top portion; and each well has a stationary seat abutting the bottom surface of the base plate.

18. A container for storing at least one personal care item, the container comprising:

a base plate, the base plate having opposed top and bottom surfaces, the base plate defining an aperture, the base plate having a wall portion irremovably extending above the top surface, the wall portion encircling the aperture;

a well extending upwardly from the base plate, the well having:

an open top portion and a closed bottom portion, the top and bottom portions collectively defining a chamber accessible through the open top portion; and a cap removably secured atop the chamber;

wherein the well extends downwardly from the base plate; and wherein a width of the base plate measured generally perpendicularly to a longitudinal axis of the base plate is no more than two inches; and wherein a maximum extension of the well below the bottom surface of the base plate is no more than three-quarters inch; whereby the base plate, the well, and the cap are collectively sized for one-handed operation.

19. The container of claim 18, wherein:

the well has a flange overlying a portion of the base plate; and the cap abuts the flange for sealing when the cap is secured atop the chamber.

20. The container of claim 19, wherein the well has a seat abutting the bottom surface of the base plate while the cap abuts the flange.

* * * * *